US008135162B2

(12) United States Patent
Holt et al.

(10) Patent No.: US 8,135,162 B2
(45) Date of Patent: Mar. 13, 2012

(54) MULTIPLE MAGNET LOUDSPEAKER

(75) Inventors: Andrew Holt, Bridgend (GB); Douglas K. Hogue, Bloomington, IN (US); Michael A. Canada, Sr., Avon, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 1121 days.

(21) Appl. No.: 11/940,019

(22) Filed: Nov. 14, 2007

(65) Prior Publication Data

US 2009/0123005 A1 May 14, 2009

(51) Int. Cl.
*H04R 1/00* (2006.01)
*H04R 9/06* (2006.01)
*H04R 11/02* (2006.01)

(52) U.S. Cl. ..... 381/412; 381/396

(58) Field of Classification Search ..... 381/412, 381/396, 398, 399, 400, 413
See application file for complete search history.

(56) References Cited

U.S. PATENT DOCUMENTS

| | | | |
|---|---|---|---|
| 4,737,992 | A | 4/1988 | Latham-Brown et al. |
| 4,979,220 | A | 12/1990 | Chen |
| 5,040,221 | A | 8/1991 | Edwards et al. |
| 5,625,701 | A | 4/1997 | Scanlan |
| 6,611,606 | B2 | 8/2003 | Guenther |
| 6,842,529 | B2 | 1/2005 | Koura et al. |
| 7,006,653 | B2 | 2/2006 | Guenther |
| 7,016,514 | B2 | 3/2006 | White et al. |
| 7,120,270 | B2 | 10/2006 | Aronson et al. |
| 7,149,323 | B2 | 12/2006 | Yamagishi |
| 7,184,567 | B2 | 2/2007 | Sugata et al. |
| 7,302,076 | B2 | 11/2007 | Guenther |
| 2002/0150275 | A1 | 10/2002 | Guenther |
| 2004/0120543 | A1 | 6/2004 | Sun |
| 2004/0131223 | A1 | 7/2004 | Stiles |
| 2004/0161129 | A1 | 8/2004 | Guenther |
| 2006/0215871 | A1 | 9/2006 | Funahashi et al. |
| 2006/0215872 | A1 | 9/2006 | Guenther |
| 2006/0233403 | A1 | 10/2006 | Nakagawa |
| 2007/0036382 | A1 | 2/2007 | Gladwin et al. |
| 2007/0230737 | A1* | 10/2007 | Hyde ..... 381/421 |

FOREIGN PATENT DOCUMENTS

| | | | |
|---|---|---|---|
| EP | 1 515 584 | A1 | 3/2005 |
| JP | 59-061299 | A | 4/1984 |
| JP | 2000-152381 | A | 5/2000 |

* cited by examiner

*Primary Examiner* — Walter L Lindsay, Jr.

(57) ABSTRACT

A loudspeaker provides increased magnetic flux from multiple magnets to drive voice coils to generate sound. The loudspeaker is formed as a smaller profile and reduced weight package. The loudspeaker includes a dual pole, first and second magnets, first and second front plates, and first and second gaps. The polarities of the first and second magnets are aligned in the same direction. The first and second magnets may be disk or ring-shaped and may be coupled to a flange of the dual pole. The first and second gaps may be formed between the inner diameters of the first and second magnets and the dual pole. The magnetic flux produced by the first and second magnets may be combined, directed, and concentrated within the first and second gaps by the dual pole and the front plates. At least portions of a first and a second voice coil may be positioned within the first and second gaps, respectively, and diaphragms may be coupled to the first and second voice coils.

20 Claims, 11 Drawing Sheets

MULTIPLE MAGNET LOUDSPEAKER

BACKGROUND OF THE INVENTION

1. Technical Field

The invention relates to loudspeakers, and in particular, to loudspeakers with multiple magnets having polarities aligned in the same direction.

2. Related Art

Loudspeakers convert electrical energy into sound and typically include a diaphragm, a magnet structure, and a voice coil. The magnet structure may include one or more magnets, a core cap, and a shell pot. The shell pot and core cap direct and concentrate a magnetic flux produced by the magnets into an air gap. The voice coil is connected to the diaphragm and is positioned in the air gap. When electrical energy flows into the voice coil, an induced magnetic field is created that interacts with the magnetic flux in the air gap. The voice coil may carry a current in a direction substantially perpendicular to the direction of the magnetic flux produced by the magnet structure, so that the interaction between the voice coil current and the magnetic flux cause oscillation of the voice coil and diaphragm, and in turn, audible sound.

Some loudspeakers may have a magnet structure with in-line magnets polarized in opposite directions, which may result in increased manufacturing complexity. The magnets used in this type of magnet structure may be magnetized prior to assembly, also increasing the manufacturing complexity. Other loudspeakers may use solid magnets to attain a high magnetic flux, but this may result in an undesirable larger profile package and/or a larger mass loudspeaker. Some loudspeakers may have a smaller profile package and/or smaller mass but produce a low magnetic flux and inaccurate voice coil movement, resulting in unsatisfactory performance. Therefore, a need exists for a loudspeaker with a smaller profile package and smaller mass that has a magnet structure that provides an increased magnetic flux and accurate voice coil movement for improved performance.

SUMMARY

A multi-way loudspeaker, such as a two-way loudspeaker, provides increased magnetic flux from multiple magnets to drive voice coils generating sound in a smaller profile and reduced weight package. In one example, the loudspeaker includes a dual pole, first and second magnets, first and second front plates, and first and second gaps. The first and second magnets may be positioned so that the polarities of the first and second magnets may be aligned in the same direction. The first and second magnets may be disk or ring-shaped and may be coupled to a flange of the dual pole. The first and second gaps may be formed between first and second magnets and the dual pole. Magnetic flux produced by the first and second magnets may be combined, directed, and concentrated by the dual pole and the first and second front plates within the first and second gaps. At least portions of a first and a second voice coil may be positioned within the first and second gaps, respectively, and diaphragms may be coupled to the first and second voice coils. The loudspeaker may provide more accurate voice coil movement, resulting in improved performance.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
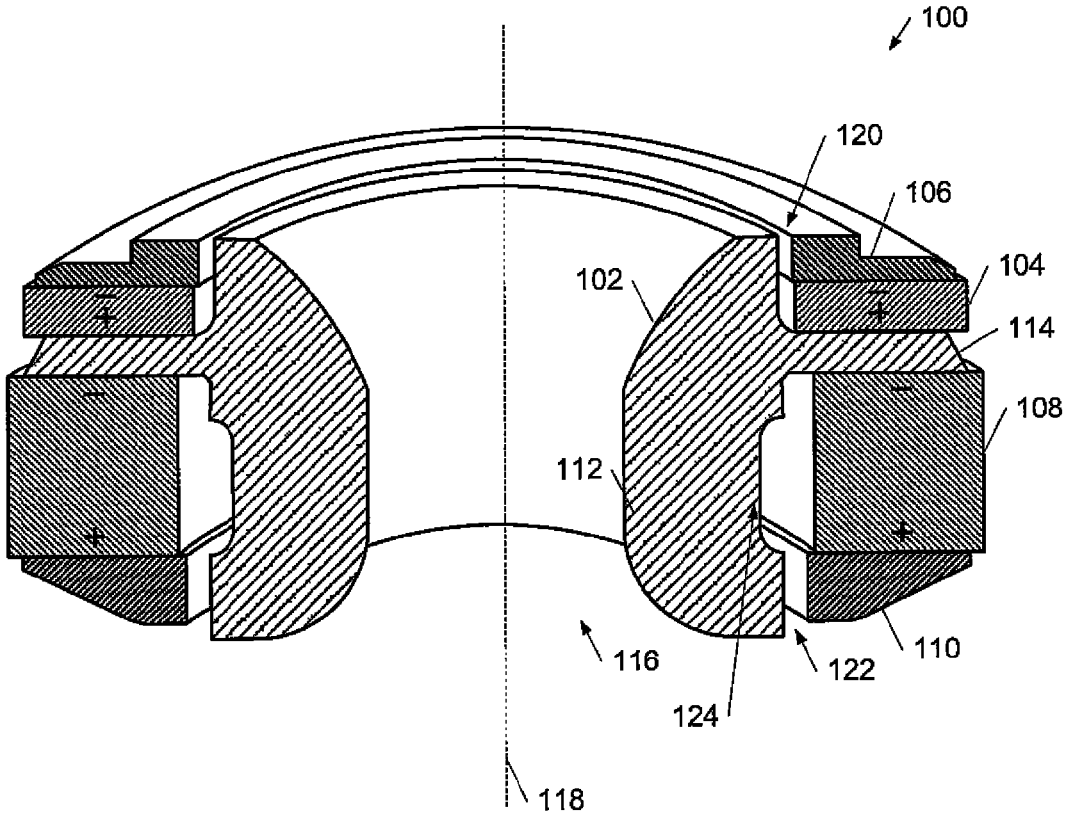
FIG. 1 illustrates a cross-section of an example magnet structure for a loudspeaker.

FIG. 1 illustrates an example of a cross-section of a magnet structure 100 for a multi-way loudspeaker. Although a two-way loudspeaker is illustrated, one, three, or more way loudspeakers are possible. The magnet structure 100 may include a dual pole 102, a first magnet 104, a first front plate 106, a second magnet 108, and a second front plate 110. The dual pole 102 may include a core 112 and a flange 114. The flange 114 may be positioned between the first magnet 104 and the second magnet 108 and extend substantially perpendicularly away from the core 112. The magnets 104 and 108 are polarized in the same direction, and may be composed of a permanent magnetic material, including neodymium, ferrite, or other permanent magnetic materials. Because the magnets 104 and 108 are polarized in the same direction, they may both contribute to a combined magnetic flux of the magnet structure 100. Magnetic flux is a measure of the quantity of magnetism. The dual pole 102 and front plates 106 and 110 may provide a low reluctance path for at least a portion of the magnetic flux generated by the magnets 104 and 108 to channel through. A magnetic circuit may be formed by the magnets 104 and 108 through the front plates 106 and 110, the dual pole 102, a first gap 120, and a second gap 122. The magnetic flux density due to the combined magnetic flux generated by the magnets 104 and 108 may be approximately 1.65 T in the first gap 120 and approximately 1.5 T in the second gap 122, for example.

The core 112, flange 114, and front plates 106 and 110 may be shaped to optimally combine, direct, and concentrate the magnetic flux path through the dual pole 102 and through the gaps 120 and 122. For example, the outer portion of the core 112 in FIG. 1 includes a notch 124 which may direct and concentrate the magnetic flux path through the core 112. In addition, the flange 114 may have a certain thickness to allow an optimal combination of the magnetic flux from each of the magnets 104 and 108. The flange 114 extends substantially perpendicularly away from the core 112, and has an angled outer portion. The angled outer portion may help to combine and direct magnetic flux. The first front plate 106 has a stepped shape with a thicker inner portion relative to an outer portion. The second front plate 110 has a partial wedge shape that is thicker on an inner portion relative to an outer portion. The magnetic flux may be combined and directed using other shapes and thicknesses of the core 112, flange 114, and front plates 106 and 110. The dual pole 102 and front plates 106 and 110 may be composed of a low reluctance magnetic material, including steel, an alloy, or other magnetic materials.

The first magnet 104 is coupled to a first planar surface of the flange 114 and the second magnet 108 is coupled to a second planar surface of the flange 114 that is opposite the first planar surface of the flange 114. In FIG. 1, the first magnet 104 and the second magnet 108 extend laterally beyond the angled outer portion of the flange 114. The first, front plate 106 is coupled to a surface of the first magnet 104 opposite the first surface of the flange 114. The second front plate 110 is coupled to a surface of the second magnet 104 opposite the second surface of the flange 114.

In FIG. 1, the dual pole 102 includes an orifice 116 formed on an inner surface of the core 112. The orifice 116 may include a partial conical shape, a substantially cylindrical shape, and a partially curved shape. The orifice 116 may allow support of the magnet structure 100 in the loudspeaker. Any suitable shape, including hollow, shaped hollow, tube loaded, and cavity core, may comprise the orifice 116. The dual pole 102 may also be solid and not include an orifice. The magnet structure 100, including the core 112, flange 114, magnets 104 and 108, front plates 106 and 110, and the orifice 116 may be concentric and symmetric about an axis of symmetry 118. The magnet structure 100 may also be non-concentric and non-symmetric. The magnets 104 and 108 may be substantially circular or annular-shaped ring magnets, may be solid, or may be other shapes. The front plates 106 and 110 may also be substantially circular or annular-shaped, may be solid, or may be other shapes. The dual pole 102, magnets 104 and 108, and front plates 106 and 110 may be coupled using an adhesive, bonding agents, mechanical fasteners, or any other fastening mechanism.

Figure 2:
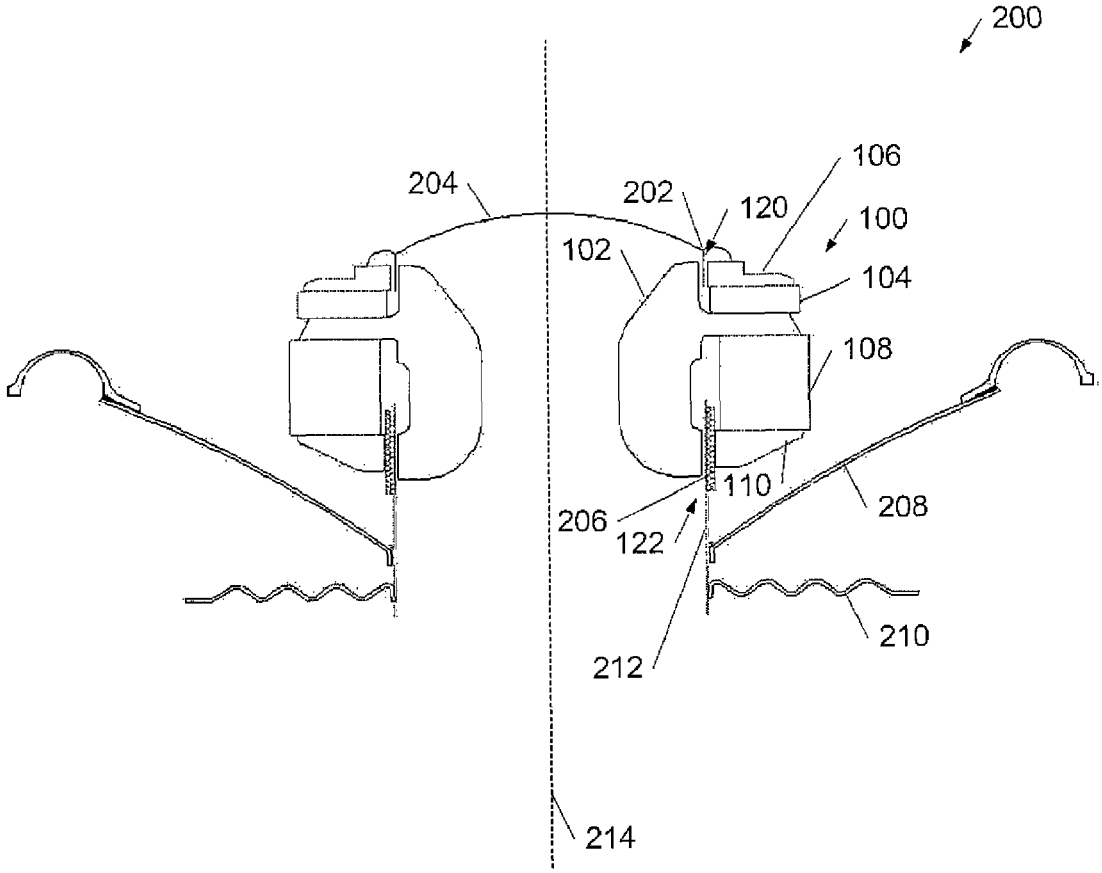
FIG. 2 illustrates a cross-section of a first example loudspeaker.

FIG. 2 illustrates a cross-section of a first example loudspeaker 200. The loudspeaker 200 includes the magnet structure 100 of FIG. 1, a tweeter voice coil 202, a tweeter dome 204, a midrange voice coil 206, a midrange diaphragm 208, a spider that is a first suspension 210, and a surround that is a second suspension 212. The voice coils 202 and 206, dome 204, and diaphragm 208 may be cylindrically symmetric about a central axis 214. For example, the tweeter voice coil 202, the tweeter dome 204, and the midrange voice coil 206 may have approximately one inch diameters and the midrange diaphragm 208 may have an approximately four inch diameter. Other dimensions of the voice coils 202 and 206, dome 204, and diaphragm 208 may be used, and the dimensions may be suitably scaled together or separately to attain desired loudspeaker performance and mechanical requirements. The tweeter voice coil 202 may be positioned in the first gap 120, and may be coupled to the tweeter dome 204. The midrange voice coil 206 may be positioned in the second gap 122, and may be coupled to the midrange diaphragm 208.

The first suspension 210 and second suspension 212 allow the midrange voice coil 206 and the midrange diaphragm 208 to reciprocate axially along the central axis 214 of the loudspeaker 200. Similarly, the tweeter voice coil 202 and the tweeter dome 204 may also reciprocate axially along the central axis 214. The voice coils 202 and 206 may include windings wound cylindrically around a former. The former may include any suitable material such as aluminum, copper, plastic, paper, composite, or other materials. The windings may include wire made from copper, aluminum, or other suitable conductive materials, and may be attached to the former using an adhesive. The number of windings encircling the former may depend upon loudspeaker size and the desired loudspeaker performance characteristics.

The voice coils 202 and 206 may reciprocate axially during operation when there is interaction in the gaps 120 and 122 between the magnetic flux from the magnets 104 and 108 and current flowing through the voice coils 202 and 206, respectively. In FIG. 2, a portion of the voice coils 202 and 206 are positioned in respective gaps 120 and 122. The magnetic flux from the magnets 104 and 108 is combined and substantially directed and concentrated in the gaps 120 and 122. The magnetic flux in each of the gaps 120 and 122 may contribute to the magnetic flux in the other of the gaps 120 and 122, through a magnetic circuit in the magnet structure 100. Current flowing through the voice coils 202 and 206 may come from an input audio signal. The input audio signal may be an analog electrical signal provided by an amplifier, a crossover, or other suitable source. The current may interact with the magnetic flux in the gaps 120 and 122, the voice coils 202 and 206, and their respective attached dome 204 and diaphragm 208 to vibrate and oscillate independently in response to the interaction. Audible sound may be produced by the independent movement of air caused by the dome 204 and diaphragm 208.

Figure 3:
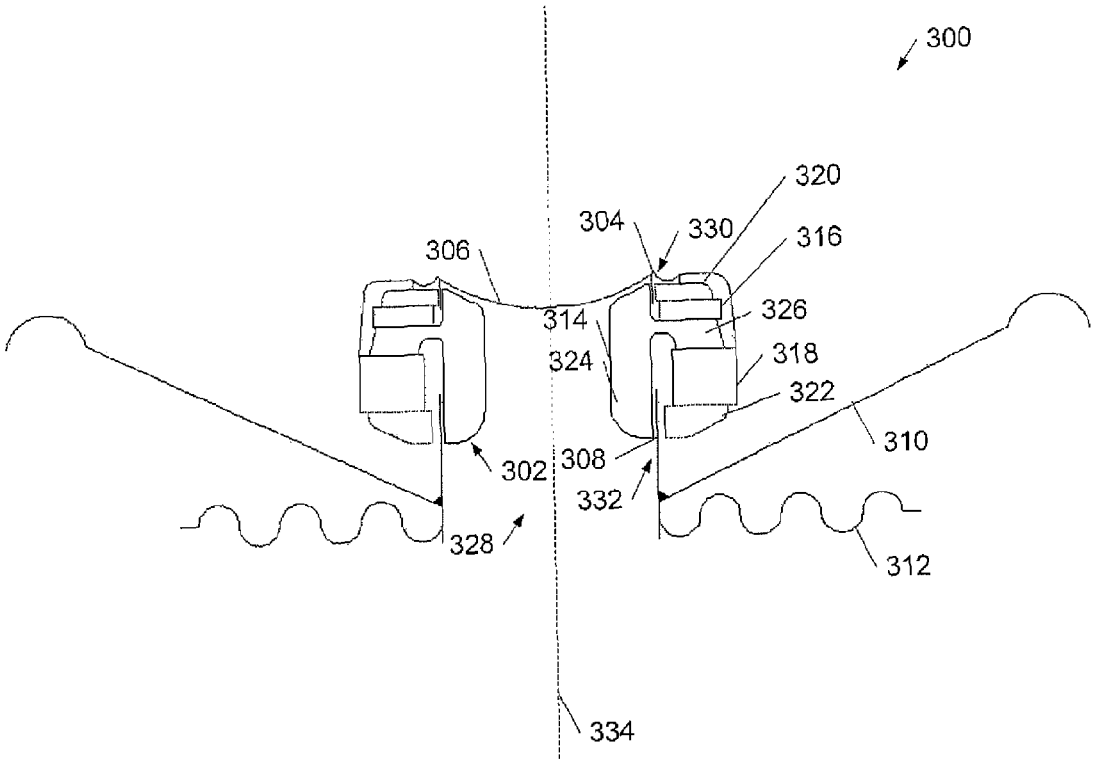
FIG. 3 illustrates a cross-section of a second example loudspeaker.

FIG. 3 illustrates a cross-section of a second example loudspeaker 300. The loudspeaker 300 includes a magnet structure 302, a tweeter voice coil 304, an inverted tweeter dome 306, a midrange voice coil 308, a midrange diaphragm 310, and a suspension 312. The magnet structure 302 includes a dual pole 314, first and second magnets 316 and 318, and first and second front plates 320 and 322. The dual pole 314 includes a core 324 and a flange 326. The flange 326 may be disposed between the first and second magnets 316 and 318, and extend substantially perpendicularly away from the core 324. Similar to the magnet structure 100 described in FIG. 1, the magnets 316 and 318 are polarized in the same direction so that they may both contribute to the combined magnetic flux of the magnet structure 302 in the first and second gaps 330 and 332. The dual pole 314 and front plates 320 and 322 may provide a low reluctance path for at least a portion of the magnetic flux generated by the magnets 316 and 318 to channel through. A magnetic circuit may be formed by the magnets 316 and 318 through the front plates 320 and 322, the dual pole 314, the first gap 330, and the second gap 332.

In FIG. 3, the core 324 and front plates 320 and 322 may be shaped to optimally combine, direct, and concentrate the magnetic flux path through the dual pole 314 and through the gaps 330 and 332. For example, the flange 326, magnets 316 and 318, and front plates 320 and 322 are concentric with an orifice 328 and with one another, and are symmetric about the axis 334. The flange 326 extends perpendicularly away from the core 324, and has a thinner inner portion relative to a thicker angled outer portion. The first magnet 316 is coupled to a first planar surface of the flange 326 and extends past the angled outer portion of the flange 326. The second magnet 318 is coupled to a second planar surface of the flange 326 that is opposite the first planar surface of the flange 326. The second magnet 318 also extends past the angled outer portion of the flange 326. The first front plate 320 is coupled to a surface of the first magnet 316 opposite the first surface of the flange 326.

The first front plate 320 has a substantially oblong shape with a curved outer portion. The second front plate 322 is coupled to a surface of the second magnet 318 opposite the second surface of the flange 326. The second front plate 322 has a partial wedge shape that is thicker on an inner portion relative to an outer portion. Other shapes and thicknesses of the core 324, flange 326, and front plates 320 and 322 may be used to combine and direct the magnetic flux. The dual pole 314 includes an orifice 328 formed on an inner surface of the core 324. The orifice 328 is symmetric about the central axis 334. In FIG. 3, the orifice 328 includes a shallow partial conical shape, a substantially cylindrical shape, and a partially curved shape. The orifice 328 may include other shapes, and may allow support of the magnet structure 302 in the loudspeaker. The magnets 316 and 318 may be generally circular or annular-shaped ring magnets. The front plates 320 and 322 may also be generally circular or annular-shaped.

The tweeter voice coil 304 may be positioned in the first gap 330, and may be coupled to the inverted tweeter dome 306. The midrange voice coil 308 may be positioned in the second gap 332, and may be coupled to the midrange diaphragm 310. The suspension 312 allows the midrange voice coil 308 and the midrange diaphragm 310 to reciprocate axially along the central axis 328. The voice coils 304 and 308 may reciprocate axially vertically during operation when there is interaction between the magnetic flux from the magnets 316 and 318 and current flowing through the voice coils 304 and 308 in the gaps 330 and 332, respectively. The magnetic flux from the magnets 316 and 318 is combined and substantially directed and concentrated in the gaps 330 and 332. The current in the voice coils 304 and 308 may interact with the magnetic flux in the gaps 330 and 332, the voice coils 304 and 308, and their respective attached dome 306 and diaphragm 310 to vibrate and oscillate independently in response to that interaction. Audible sound may be produced by the independent movement of air caused by the dome 306 and diaphragm 310.

Figure 4:
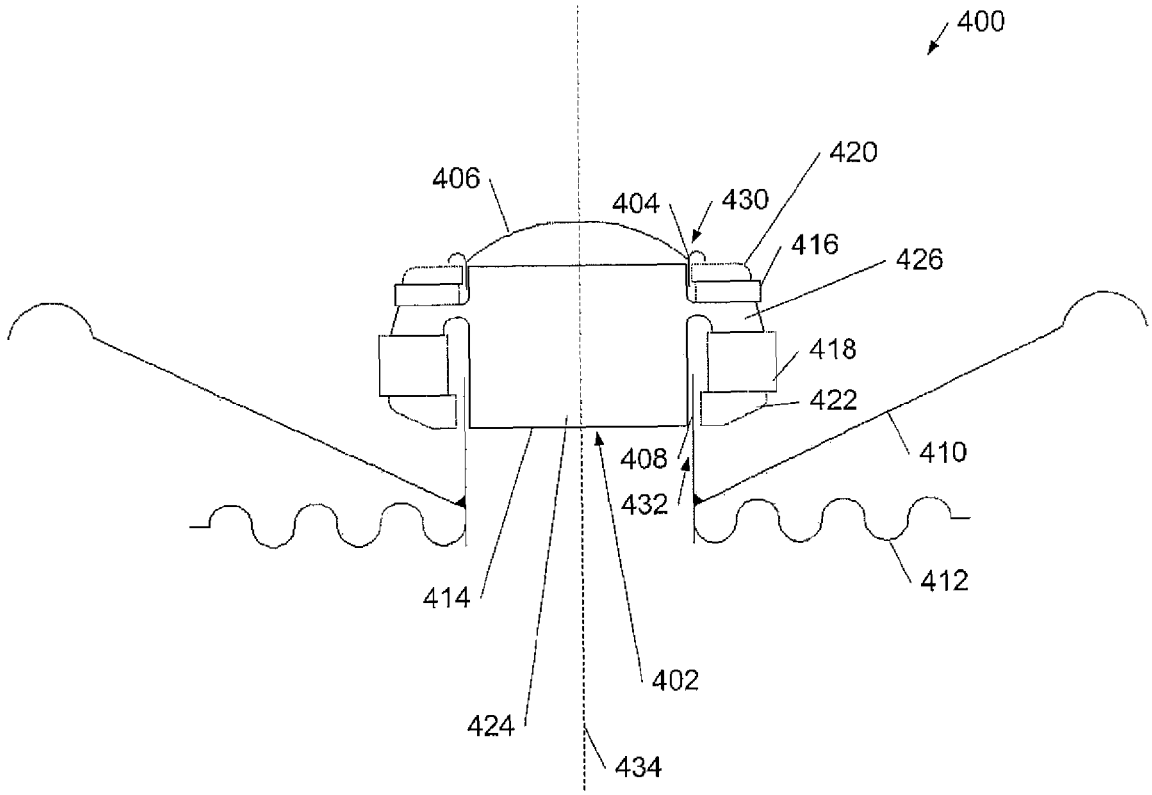
FIG. 4 illustrates a cross-section of a third example loudspeaker.

FIG. 4 illustrates a cross-section of a third example loudspeaker 400. The loudspeaker 400 includes a magnet structure 402, a tweeter voice coil 404, a tweeter dome 406, a midrange voice coil 408, a midrange diaphragm 410, and a suspension 412. The magnet structure 402 includes a dual pole 414, first and second magnets 416 and 418, and first and second front plates 420 and 422. The dual pole 414 includes a core 424 and a flange 426, and the flange may be positioned between the first and second magnets 416 and 418. The flange 426 may extend perpendicularly away from the core 424. The magnets 416 and 418 are polarized in the same direction so that they may both contribute to the combined magnetic flux of the magnet structure 402. The dual pole 414 and front plates 420 and 422 may provide a low reluctance path for at least a portion of the magnetic flux generated by the magnets 416 and 418 to channel through. A magnetic circuit may be formed by the magnets 416 and 418 through the front plates 420 and 422, the dual pole 414, a first gap 430, and a second gap 432.

In FIG. 4, the core 424 and front plates 420 and 422 may be shaped to combine, direct, and concentrate the magnetic flux path through the dual pole 414 and through the gaps 430 and 432. For example, the core 424 is symmetric about a central axis 434, and is substantially solid and cylindrical. The top and bottom of the core 324 are planar surfaces. The flange 426, magnets 416 and 418, and front plates 420 and 422 are concentric with the core 424 and with one another, and are symmetric about the axis 434. The flange 426 extends perpendicularly away from the core 424, and has a thinner inner portion relative to a thicker angled outer portion. The first magnet 416 is coupled to a first planar surface of the flange 426 and extends past the angled outer portion of the flange 426. The second magnet 418 is coupled to a second planar surface of the flange 426 that is opposite the first planar surface of the flange 426. The second magnet 418 also extends past the angled outer portion of the flange 426. The first front plate 420 is coupled to a surface of the first magnet 416 opposite the first surface of the flange 426. The first front plate 420 has a substantially oblong shape with a curved outer portion. The second front plate 422 is coupled to a surface of the second magnet 418 opposite the second surface of the flange 426. The second front plate 422 has a partial wedge shape that is thicker on an inner portion relative to an outer portion. Other shapes and thicknesses of the core 424, flange 426, and front plates 420 and 422 may be used to combine and direct the magnetic flux.

The tweeter voice coil 404 may be positioned in the first gap 430, and may be coupled to the tweeter dome 406. The midrange voice coil 408 may be positioned in the second gap 432, and may be coupled to the midrange diaphragm 410. The suspension 412 allows the midrange voice coil 408 and the midrange diaphragm 410 to reciprocate axially along the central axis 434 of the loudspeaker 400. The voice coils 404 and 408 may reciprocate axially vertically during operation when there is interaction between the magnetic flux from the magnets 416 and 418 and current flowing through the voice coils 404 and 408 in the gaps 430 and 432, respectively. The magnetic flux from the magnets 416 and 418 is substantially directed and concentrated in the gaps 430 and 432. The current in the voice coils 404 and 408 may interact with the magnetic flux in the gaps 430 and 432, the voice coils 404 and 408, and their respective attached dome 406 and diaphragm 410 to vibrate and oscillate independently in response to that interaction. Audible sound may be produced by the independent movement of air caused by the dome 406 and diaphragm 410.

Figure 5:
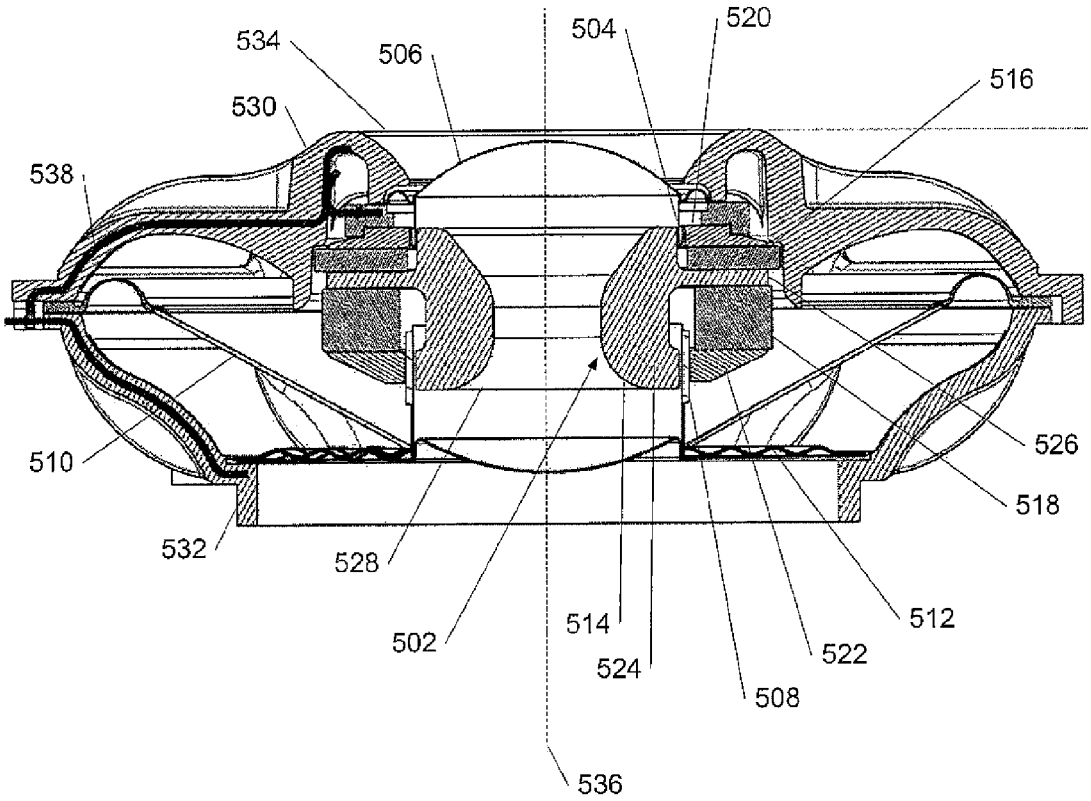
FIG. 5 illustrates a cross-section of a fourth example loudspeaker.

FIG. 5 illustrates a cross-section of a fourth example loudspeaker 500. The loudspeaker 500 in FIG. 5 includes a magnet structure 502, a tweeter voice coil 504, a tweeter dome 506, a midrange voice coil 508, a midrange diaphragm 510, and a suspension 512. The magnet structure 502 includes a dual pole 514, first and second magnets 516 and 518, and first and second front plates 520 and 522. Similar to the magnet structure 100 described in FIG. 1, the magnets 516 and 518 are polarized in the same direction so that they may both contribute to the combined magnetic flux of the magnet structure 502. The dual pole 514 includes a core 524 and a flange 526. The flange 526 may extend perpendicularly away from the core 524, as shown in FIG. 5. The dual pole 514 includes an orifice that may be shaped to accept a motor support 528. The magnets 516 and 518 may be directly coupled to the flange 526, and the front plates 520 and 522 may be directly coupled to the magnets 516 and 518, respectively. The magnet structure 502, including the dual pole 514, magnets 516 and 518, and front plates 520 and 522, may be cylindrically symmetric about an axis of symmetry 536.

The loudspeaker 500 in FIG. 5 also includes the motor support 528, an upper chassis 530, a lower chassis 532, and a dust cap 534. The magnet structure 502 may be supported by the motor support 528 by fitting into the orifice formed in the core 524. The magnet structure 502, motor support 528, tweeter voice coil 504, tweeter dome 506, midrange voice coil 508, midrange diaphragm 510, and suspension 512 may operate as described previously, and may be assembled within the upper chassis 530 and lower chassis 532 to form the loudspeaker 500. The dust cap 534 may be positioned on top of the upper chassis 530 to protect the tweeter dome 506 from dust and other contaminants. The upper chassis 530 and lower chassis 532 may be composed of aluminum, steel, plastic, composites, or other suitable materials. The motor support 528, upper chassis 530, and lower chassis 532 may be of any suitable shape to contain and support the components of the loudspeaker 500 for a particular application or environment. The loudspeaker 500 may include a conductor 538 to the voice coils 504 and 508 for providing an input audio signal from an amplifier, a crossover, or another source.

In FIG. 5, the core 524 and front plates 520 and 522 may be shaped to combine, direct, and concentrate the magnetic flux path through the dual pole 514. The orifice of the core 524 is symmetric about the axis 536. The orifice may include a partially conical shape, a substantially cylindrical shape, and a partially curved shape. The outer portion of the core 524 has a notch which may direct and concentrate the magnetic flux path through the core 524. The flange 526, magnets 516 and 518, and front plates 520 and 522 are concentric with the orifice and with one another, and are symmetric about the axis 536. The flange 526 extends perpendicularly away from the core 524, and has an angled outer portion. The first magnet 516 is coupled to a first planar surface of the flange 526 and extends past the angled outer portion of the flange 526. The second magnet 518 is coupled to a second planar surface of the flange 526 that is opposite the first planar surface of the flange 526. The second magnet 518 also extends past the angled outer portion of the flange 526. The first front plate 520 is coupled to a surface of the first magnet 516 opposite the first surface of the flange 526. The first front plate 520 has a stepped shape with a thicker inner portion relative to an outer portion. The second front plate 522 is coupled to a surface of the second magnet 518 opposite the second surface of the flange 526. The second front plate 522 has a partial wedge shape that is thicker on an inner portion relative to an outer portion. Other shapes and thicknesses of the core 524, flange 526, and front plates 520 and 522 may be used to combine and direct the magnetic flux.

Figure 6:
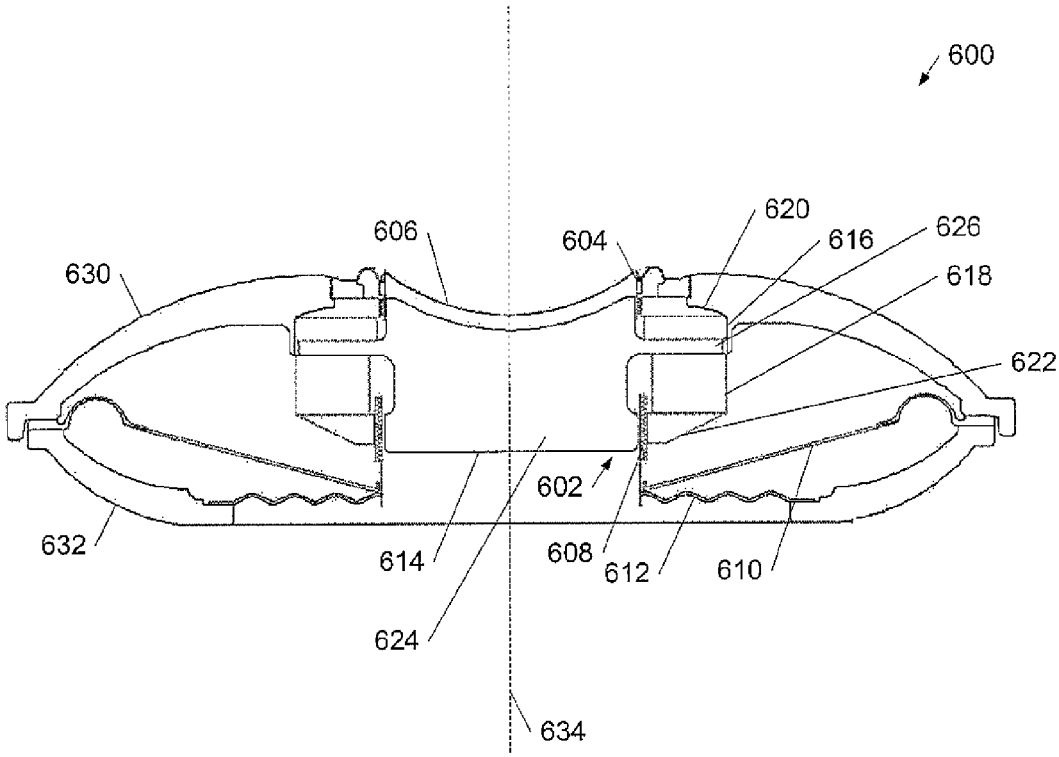
FIG. 6 illustrates a cross-section of a fifth example loudspeaker.

FIG. 6 illustrates a cross-section of a fifth example loudspeaker 600. The loudspeaker 600 is an example of a lower profile loudspeaker with a similar configuration as the loudspeakers described previously. The loudspeaker 600 in FIG. 6 includes a magnet structure 602, a tweeter voice coil 604, an inverted tweeter dome 606, a midrange voice coil 608, a midrange diaphragm 610, and a suspension 612. The magnet structure 602 includes a dual pole 614, first and second magnets 616 and 618, and first and second front plates 620 and 622. The magnets 616 and 618 are polarized in the same direction so that they may both contribute to the combined magnetic flux of the magnet structure 602. The dual pole 614 includes a core 624 and a flange 626, and the flange 626 may extend substantially perpendicularly away from the core 624. The magnets 616 and 618 may be directly coupled to the flange 626, and the front plates 620 and 622 may be directly coupled to the magnets 616 and 618, respectively. The magnet structure 602, including the dual pole 614, magnets 616 and 618, and front plates 620 and 622, may be cylindrically symmetric about an axis of symmetry 634.

The loudspeaker 600 in FIG. 6 also includes an upper chassis 630 and a lower chassis 632. The tweeter voice coil 604, inverted tweeter dome 606, midrange voice coil 608, midrange diaphragm 610, and suspension 612 may operate as described previously, and may be assembled within the upper chassis 630 and lower chassis 632 to form the loudspeaker 600. The inverted tweeter dome 606 further reduces the height of the loudspeaker 600. The upper chassis 630 and lower chassis 632 may be composed of aluminum, steel, plastic, composite, or other suitable materials. The upper chassis 630 and lower chassis 632 may be of any suitable shape to contain and support the components of the loudspeaker 600 for a particular application or environment.

In FIG. 6, the core 624 and front plates 620 and 622 may be shaped to direct and concentrate the magnetic flux path through the dual pole 614. The core 624 is symmetric about a central axis 634, and is substantially solid and cylindrical. The top and bottom of the core 624 are planar surfaces. The flange 626, magnets 616 and 618, and front plates 620 and 622 are concentric with the core 624 and with one another, and are symmetric about the axis 634. The flange 626 extends perpendicularly away from the core 624, and has a substantially oblong shape. The first magnet 616 is coupled to a first planar surface of the flange 626 and extends past the angled outer portion of the flange 626. The second magnet 618 is coupled to a second planar surface of the flange 626 that is opposite the first planar surface of the flange 626. The second magnet 618 also extends past the angled outer portion of the flange 626. The first front plate 620 is coupled to a surface of the first magnet 616 opposite the first surface of the flange 626. The first front plate 620 has a stepped shape with a thicker inner portion relative to an outer portion. The second front plate 622 is coupled to a surface of the second magnet 618 opposite the second surface of the flange 626. The second front plate 622 has a partial wedge shape that is thicker on an inner portion relative to an outer portion. Other shapes and thicknesses of the core 624, flange 626, and front plates 620 and 622 may be used to combine and direct the magnetic flux.

The example loudspeakers in FIGS. 1-6 may provide increased magnetic flux in the gaps due to the combination, configuration, and arrangement of their respective dual poles, front plates, and magnets, as described above. In particular, because the magnets may have polarities aligned in the same direction in the loudspeakers in FIGS. 1-6, the magnetic flux contributions of each of the magnets may be combined, directed, and concentrated in the gaps. Accordingly, voice coils that are positioned in the gaps will interact with the increased magnetic flux in the gaps such that the movement of the voice coils is more accurate, resulting in improved loudspeaker performance.

Figure 7:
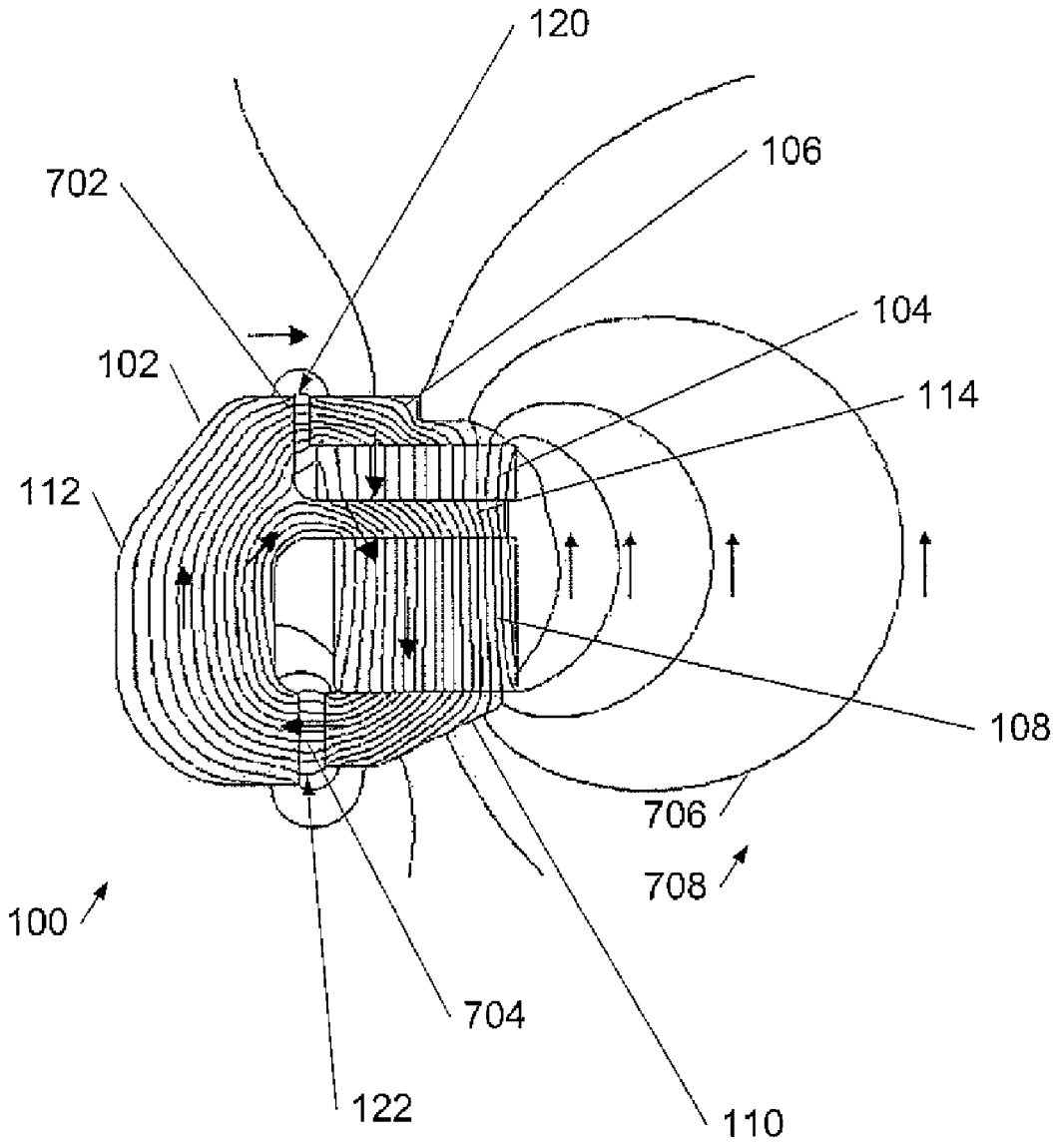
FIG. 7 illustrates the magnetic flux for the example magnet structure of FIG. 1.

FIG. 7 schematically illustrates the magnetic flux for the example magnet structure 100 of FIG. 1. The magnets 104 and 108 are polarized in the same direction to direct, combine, and increase the concentration of their respective magnetic fluxes in the gaps 120 and 122. There is a higher concentration of magnetic flux lines 702 and 704 in the gaps 120 and 122, compared to a concentration of magnetic flux lines 706 in the region 708 outside of the gaps 120 and 122. Moreover, the magnetic flux lines due to the magnets 104 and 108 combine with one another in the core 112 as well as in the flange 114 and the front plates 106 and 110. The core 112, flange 114, and front plates 106 and 110 are arranged and configured such that the magnets 104 and 108 combine their individual contributions of magnetic flux and such that the magnetic flux is substantially concentrated in the gaps 120 and 122. As previously described, the magnet structure 100 may drive two voice coils (not shown) that are positioned in the gaps 120 and 122. The increased magnetic flux in the gaps 120 and 122 that results from the magnet structure 100 allows for more accurate voice coil movement and increased loudspeaker performance.

Figure 8:
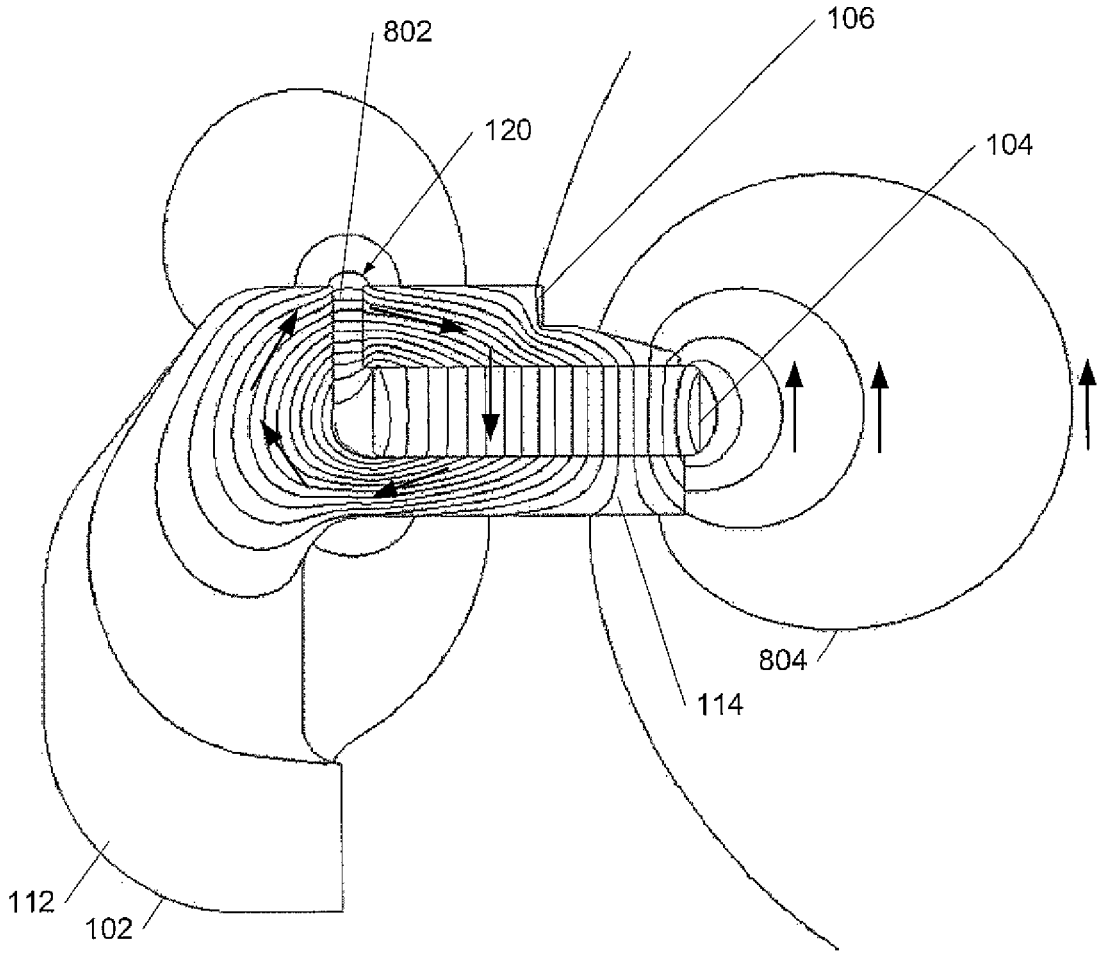
FIG. 8 illustrates the magnetic flux of a first magnet of the example magnet structure of FIG. 7.
Figure 9:
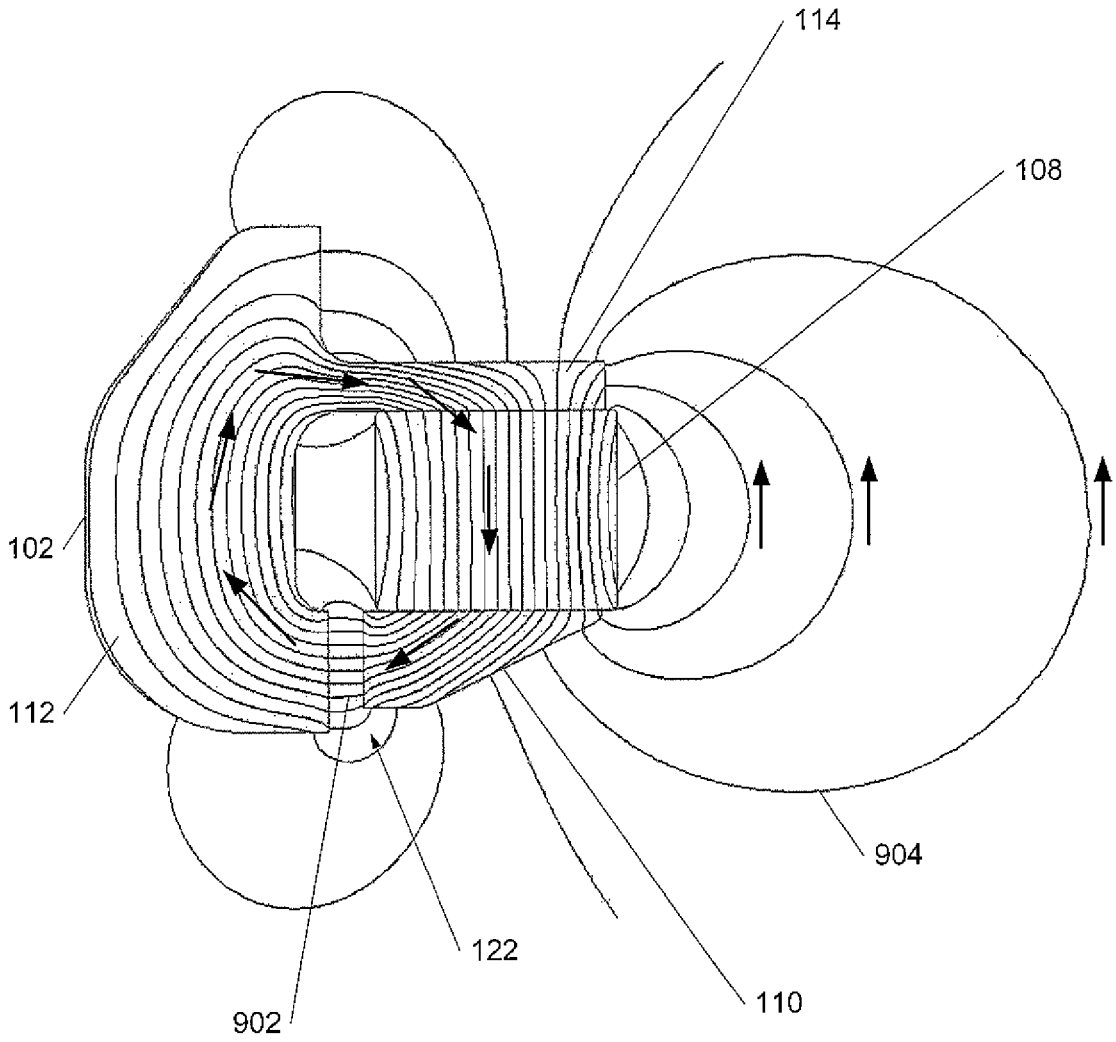
FIG. 9 illustrates the magnetic flux of a second magnet of the example magnet structure of FIG. 7.

FIGS. 8 and 9 schematically illustrate the individual magnetic flux contributions of the two magnets of the example magnet structure 100 of FIG. 7. FIG. 8 schematically illustrates the magnetic flux contribution of the first magnet 104 without the magnetic flux contribution of the second magnet 108. FIG. 8 shows that the front plate 106 and the core 112 and flange 114 of the dual pole 102 may direct and concentrate the magnetic flux of the first magnet 104 within the gap 120. There is a higher concentration of magnetic flux lines 802 in the gap 120 compared to a concentration of magnetic flux lines 804 in other regions. En FIG. 8, the direction of the magnetic flux due to the first magnet 104 and without the second magnet 108 is substantially from right to left in the flange 114.

FIG. 9 schematically illustrates the magnetic flux contribution of the second magnet 108 without the magnetic flux contribution of the first magnet 104. FIG. 9 shows that the front plate 110 and the core 112 and flange 114 of the dual pole 102 may direct and concentrate the magnetic flux of the second magnet 108 within the gap 122. There is a higher concentration of magnetic flux lines 902 in the gap 122 compared to a concentration of magnetic flux lines 904 in other regions. In FIG. 9, the direction of the magnet flux due to the second magnet 108 and without the first magnet 104 is substantially from left to right in the flange 114.

Therefore, as shown in FIGS. 8 and 9, the individual magnetic fluxes of magnets 104 and 108 flow in opposite directions in the flange 114 when each magnet is examined in isolation. However, the magnets 104 and 108 may be positioned on opposite surfaces of the flange 114, such that their respective magnetic polarities are aligned in the same direction. In this configuration, the combined magnetic flux schematically illustrated in FIG. 7 may result from the individual magnetic flux lines of FIGS. 8 and 9 for the first magnet 104 and the second magnet 108, respectively. In other words, the magnetic flux contributions from the magnets 104 and 108 may be combined, directed, and concentrated to create an increased magnetic flux in gaps 120 and 122, as shown in FIG. 7.

Figure 10:
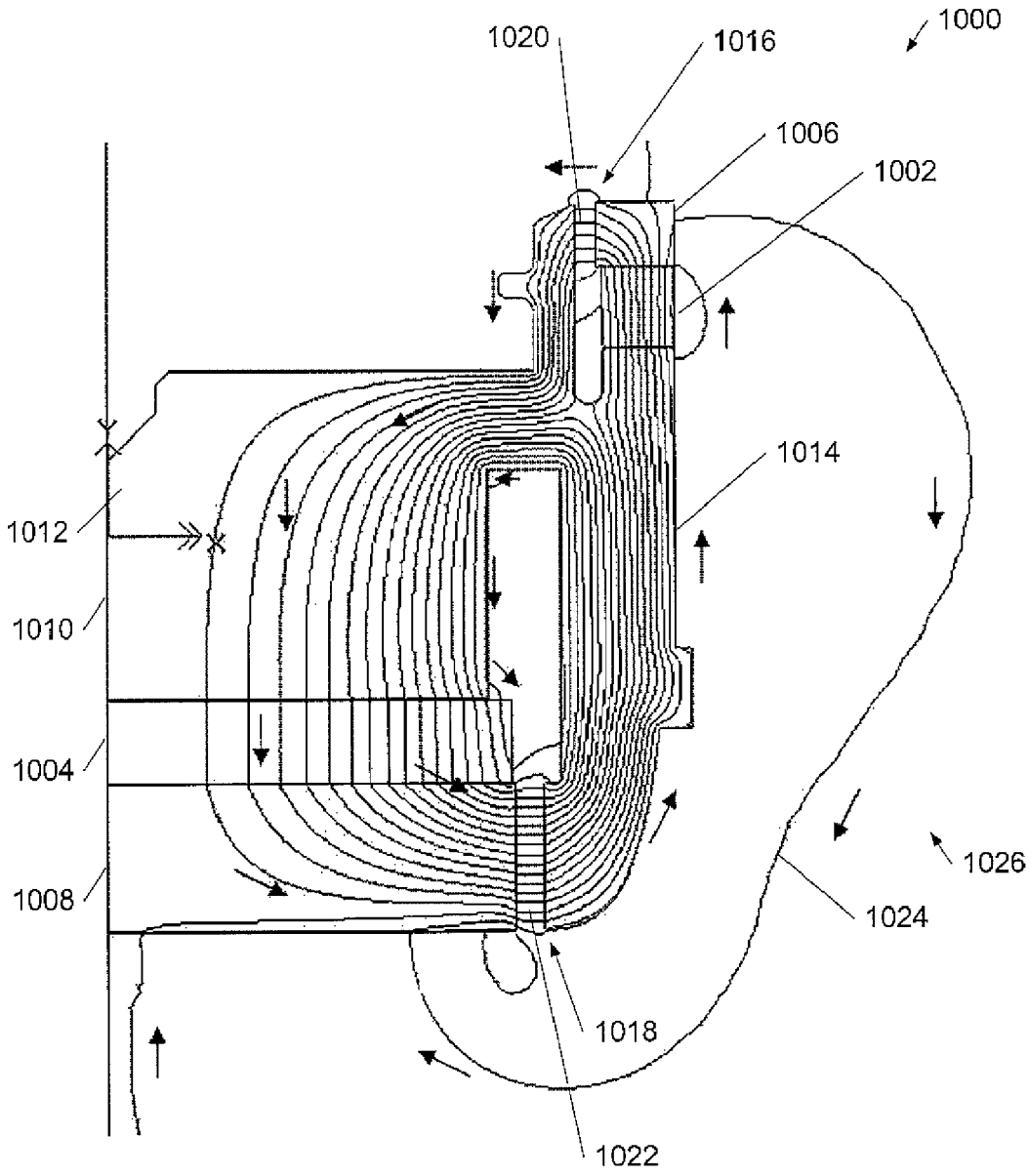
FIG. 10 illustrates the magnetic flux of an alternative example magnet structure.

FIG. 10 schematically illustrates the magnetic flux of an alternative example magnet structure 1000. The magnet structure 1000 includes a ring or annular-shaped magnet 1002, a solid magnet 1004, front plate 1006 and core cap 1008, and a shell pot 1010. The shell pot 1010 includes a core 1012 and an extension 1014. The magnets 1002 and 1004 are polarized in the same direction to increase the concentration of their magnetic flux in the gaps 1016 and 1018. As seen in FIG. 10, there is a higher concentration of magnetic flux lines 1020 and 1022 in the gaps 1016 and 1018, compared to a concentration of magnetic flux lines 1024 in the region 1026 outside of the gaps 1016 and 1018. Moreover, the magnetic flux lines due to the magnets 1002 and 1004 combine with one another in the core 1012 of the shell pot 1010 as well as in the extension 1014 and the front plate 1006 and core cap 1008.

The core 1012, extension 1014, front plate 1006, and core cap 1008 are arranged and configured such that the magnets 1002 and 1004 combine their individual magnetic flux contributions and such that the magnetic flux is substantially directed and concentrated in the gaps 1016 and 1018. The magnet structure 1000 may drive two voice coils (not shown) positioned in the gaps 1116 and 1118. The increased magnetic flux in the gaps 1016 and 1018 that results from the magnet structure 1000 may allow for more accurate voice coil movement and increased loudspeaker performance. The magnet structure 1010 in FIG. 10 may be used in a larger sized loudspeaker, for example, in a loudspeaker with an approximately 16 mm diameter tweeter driver and an approximately 80 mm diameter midrange driver. Another example of a loudspeaker using the magnet structure 1010 is with an approximately 80-100 mm diameter midrange driver and an approximately 200-300 mm subwoofer driver. Other dimensions, configurations, and combinations of drivers may be used.

Figure 11:
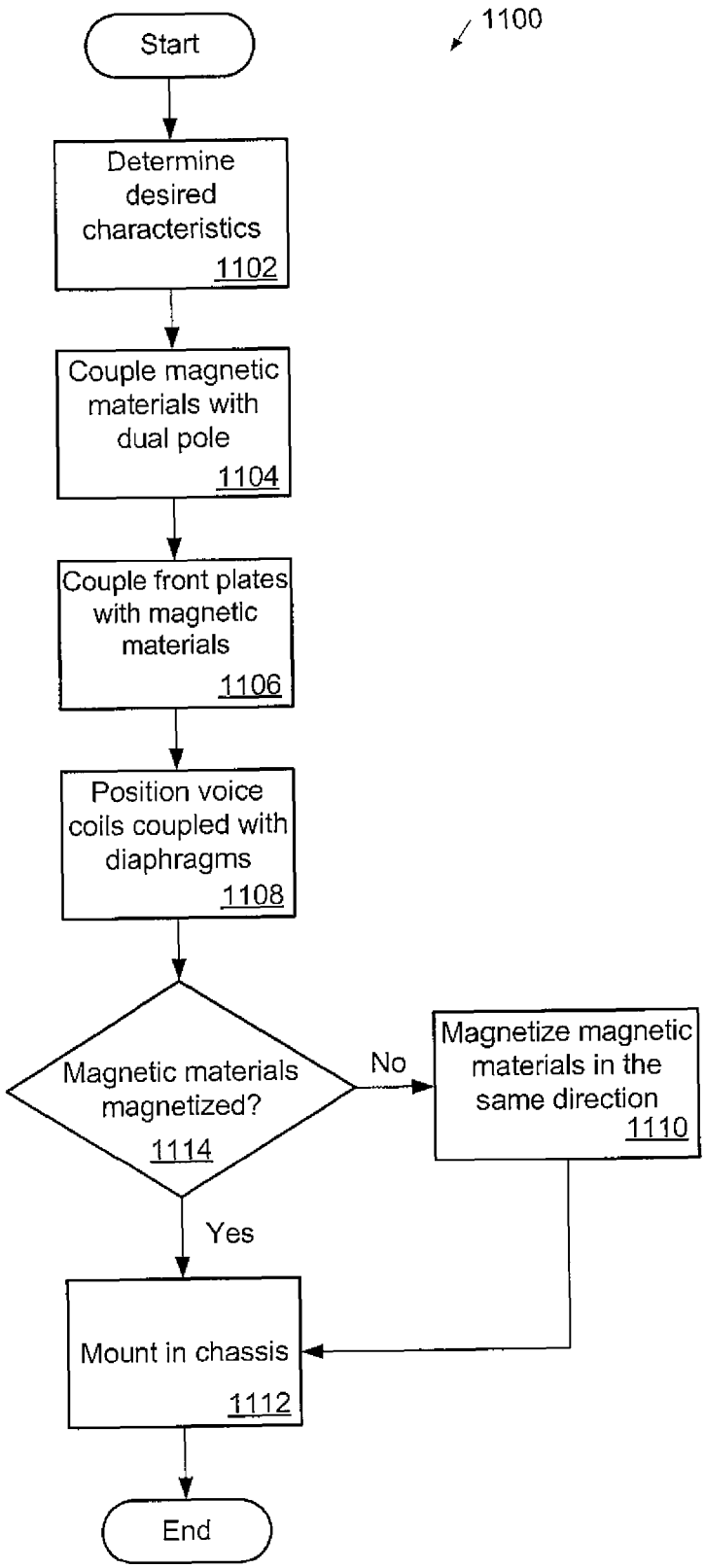
FIG. 11 illustrates an example process to manufacture a loudspeaker.

FIG. 11 illustrates an example process 1100 to manufacture a loudspeaker, such as the example loudspeakers of FIGS. 1-6. The desired audio characteristics, material requirements, and physical requirements of the loudspeaker may be determined in Act 1102. For example, audio characteristics may include power dissipation, frequency ranges, impedance, and other characteristics. The physical requirements of a loudspeaker may include the mass or dimensional requirements for a specific application, environment, or manufacturing process. In Act 1104, first and second magnetic materials may be coupled with a dual pole. The dual pole may be composed of a low reluctance magnetic material. The magnetic materials may be non-magnetized when they are coupled with the dual pole, or may already be magnetized. If the magnetic materials are initially non-magnetized, the coupling of the magnetic materials with the dual pole is simplified. The initially non-magnetized magnetic materials will not interact magnetically with one another or the dual pole during the coupling in Act 1104. The dual pole may have a substantially cylindrical core and a flange protruding substantially perpendicularly from the outer surface of the core. The dual pole may be configured to allow coupling of the magnets to surfaces of the flange. The magnets may be of a ring or annular shape, or may comprise other shapes. The magnets may be coupled to the dual pole or flange of the dual pole by adhesive, mechanical fastener, weld, or other fastening means.

In Act 1106, first and second front plates may be coupled with the first and second magnetic materials. The front plates may be of a ring or annular shape, and may be composed of a low reluctance magnetic material. The front plates may be adapted to direct and concentrate a magnetic flux of the first and second magnets between gaps formed by the dual pole, magnets, and front plates. In Act 1108, first and second voice coils that are coupled to diaphragms may be positioned in the gaps. The first and second voice coils may be positioned such that the magnetic flux of the magnetized first and second magnetic materials will interact with current flowing through the voice coils and allow reciprocating axial movement of the voice coils and the attached diaphragms. The first and second voice coils may be a tweeter and a midrange voice coil, respectively, or may be other types of voice coils.

At Act 1114, it is determined whether the magnetic materials are magnetized. If the magnetic materials are magnetized and their polarities are aligned in the same direction, then the method 1100 may continue to Act 1112. If the magnetic materials are not initially magnetized, then the method 1100 may continue to Act 1110. In Act 1110, the first and second magnetic materials may be magnetized such that the polarities of the magnets are aligned in the same direction. The first and second magnetic materials were coupled to the dual pole in Act 1104, and the first and second front plates were coupled to the first and second magnetic materials in Act 1106. Therefore, the magnetization of the first and second magnetic materials may be performed after assembly of the magnet structure. The magnetization of the first and second magnetic materials in Act 1110 may be performed simultaneously. Magnetizing the first and second magnets in this fashion allows both magnets to combine their magnetic flux in the gaps and provide for more accurate voice coil movement in the gaps. The loudspeaker may be assembled by mounting the magnet structure with the magnetized magnetic materials, the voice coils, and the diaphragm in a chassis in Act 1112, along with a suspension, wiring, and other components.

While various embodiments of the invention have been described, it will be apparent to those of ordinary skill in the art that many more embodiments and implementations are possible within the scope of the invention. For example, other configurations, arrangements, and combinations of domes, diaphragms, cones, and/or voice coils for tweeter, midrange, and/or subwoofer drivers may be used with the motor structures described. Accordingly, the invention is not to be restricted except in light of the attached claims and their equivalents.

We claim:

1. A loud speaker having a magnet structure, the magnet structure comprising:

a dual pole comprising a core structure having a first planar surface and a second planar surface;

a first magnet coupled to the first planar surface; and a second magnet coupled to the second planar surface;

where the first and second magnets are positioned so that a polarity of the first magnet is aligned in a same direction as a polarity of the second magnet.

2. The magnet structure of claim 1, where the second planar surface is substantially opposite the first planar surface, and the first and second planar surfaces form a flange that extends substantially perpendicularly away from the core structure.

3. The magnet structure of claim 1, where the first and second magnets have a substantially annular shape, and the dual pole, the first magnet and the second magnet are substantially concentric about a central axis of the magnet structure.

4. The magnet structure of claim 1, further comprising:

a first front plate coupled to the first magnet;

a first gap formed between the first front plate and the dual pole;

a second front plate coupled to the second magnet; and a second gap formed between the second front plate and the dual pole;

where the first and second front plates are positioned to combine, direct, and concentrate a magnetic flux of the first and second magnets substantially within the first and second gaps.

5. The magnet structure of claim 4, where the first and second front plates have a substantially annular shape and are substantially concentric about a central axis of the magnet structure.

6. The magnet structure of claim 1, further comprising:

a first front plate coupled to the first magnet and comprising a stepped shape with a thicker inner portion relative to an outer portion; and a second front plate coupled to the second magnet and comprising a partial wedge shape;

where the first and second magnets extend laterally beyond the first and second planar surfaces of the dual pole.

7. The magnet structure of claim 1, where the core comprises an orifice formed in an inner surface of the core structure, the orifice adapted to allow support of the magnet structure in the loudspeaker.

8. A loudspeaker having a magnet structure, the magnet structure comprising:

a first magnet having a first polarity and a first magnetic flux;

a second magnet having a second polarity aligned in a same direction as the first polarity, and a second magnetic flux; and a dual pole coupled to the first and second magnets, the dual pole comprising a core structure having a flange, where a combined magnetic flux flows substantially in the dual pole, the combined magnetic flux comprising the first magnetic flux and the second magnetic flux.

9. The magnet structure of claim 8, where the first and second magnets are coupled to the flange and positioned such that the combined magnetic flux flows substantially in the core structure and the flange, the flange extending substantially perpendicularly away from the core.

10. The magnet structure of claim 8, where the first and second magnets have a substantially annular shape, and the dual pole, the first magnet, and the second magnet are substantially concentric about a central axis of the magnet structure.

11. The magnet structure of claim 8, further comprising:

a first front plate coupled to the first magnet;

a first gap formed between the first front plate and the dual pole;

a second front plate coupled to the second magnet; and a second gap formed between the second plate and the dual pole;

where the first and second front plates are positioned to direct and concentrate the combined magnetic flux substantially within the first and second gaps.

12. The magnet structure of claim 11, where the first and second front plates have a substantially annular shape and are substantially concentric about a central axis of the magnet structure.

13. The magnet structure of claim 8, further comprising:

a first front plate coupled to the first magnet and comprising a stepped shape with a thicker inner portion relative to an outer portion; and a second front plate coupled to the second magnet and comprising a partial wedge shape;

where the first and second magnets extend laterally beyond the first and second planar surfaces of the dual pole.

14. The magnet structure of claim 8, where the core comprises and orifice formed in an inner surface of the core structure, the orifice adapted to allow support of the magnet structure in the loudspeaker.

15. A method of manufacturing a magnet structure of a loudspeaker, comprising:

Providing a dual pole, the dual pole comprising a core structure having a first planar surface and a second planar surface;

coupling a first magnetic material to the first planar surface and a second magnetic material to the second planar surface; and magnetizing the first and second magnetic materials such that a polarity of the first magnetic material is aligned in a same direction as a polarity of the second magnetic material, if the first and second magnetic materials are not already magnetized.

16. The method of claim 15, further comprising forming a flange that extends perpendicularly away from the core structure, the flanged formed from the first and second planar surfaces.

17. The method of claim 15, further comprising positioning the dual pole, the first magnetic material, and the second magnetic material to be substantially concentric about a central axis of the magnet structure, the first and second magnetic materials having a substantially annular shape.

18. The method of claim 15, further comprising:

coupling a first front plate to the first magnetic material;

forming a first gap between the first front plate and the dual pole;

coupling a second front plate to the second magnetic material; and forming a second gap between the second front plate and the dual pole;

such that the first and second front plates are positioned to combine, direct, and concentrate a magnetic flux of the first and second magnet gaps.

19. The method of claim 18, further comprising positioning the first and second front plates to be substantially concentric about a central axis of the magnet structure, the first and second front plates have a substantially annular shape.

20. The method of claim 15, further comprising forming an orifice in an inner surface of the core structure, the orifice adapted to allow support of the magnet structure in the loudspeaker.

* * * * *

UNITED STATES PATENT AND TRADEMARK OFFICE

CERTIFICATE OF CORRECTION

PATENT NO. : 8,135,162 B2
APPLICATION NO. : 11/940019
DATED : March 13, 2012
INVENTOR(S) : Holt et al.

It is certified that error appears in the above-identified patent and that said Letters Patent is hereby corrected as shown below:

In FIG. 5, the loudspeaker should be labeled with reference numeral 500.

At column 3, line 26, "...the second magnet 104" should be changed to -- the second magnet 108 --.

At column 5, line 28, "...central axis 328..." should be changed to -- central axis 334 --.

At column 5, line 66, "...core 324..." should be changed to -- core 424 --.

At column 9, line 9, "En FIG. 8..." should be changed to -- In FIG. 8 --.

At column 9, line 59, "...gaps 1116 and 1118..." should be changed to -- gaps 1016 and 1018 --.

At column 9, line 63, "...magnet structure 1010..." should be changed to -- magnet structure 1000 --.

At column 9, line 67, "...magnet structure 1010..." should be changed to -- magnet structure 1000 --.

At column 12, lines 37–38, claim 14, "...comprises and orifice..." should be changed to
-- comprises an orifice --.

At column 12, line 44, claim 15, "Providing a dual pole..." should be changed to
-- providing a dual pole --.

At column 12, line 57, claim 16, "...the flanged formed..." should be changed to
-- the flange formed --.

Signed and Sealed this
Twenty-ninth Day of January, 2013

David J. Kappos

David J. Kappos
*Director of the United States Patent and Trademark Office*